US007138160B1

(12) United States Patent
Dupont et al.

(10) Patent No.: US 7,138,160 B1
(45) Date of Patent: Nov. 21, 2006

(54) WATER SOLUBLE RETENTION AGENT

(75) Inventors: Francois Dupont, Lyons (FR); Henri Grondin, Sathonay Village (FR); Georges Ravet, Bouzigues (FR); Jean-Marc Suau, Lucenay (FR)

(73) Assignee: Coatex S.A.S., Genay (FR)

( * ) Notice: Subject to any disclaimer, the term of this patent is extended or adjusted under 35 U.S.C. 154(b) by 81 days.

(21) Appl. No.: 10/030,988

(22) PCT Filed: Jul. 10, 2000

(86) PCT No.: PCT/FR00/01992

§ 371 (c)(1),
(2), (4) Date: Apr. 12, 2002

(87) PCT Pub. No.: WO01/06057

PCT Pub. Date: Jan. 25, 2001

(30) Foreign Application Priority Data

Jul. 16, 1999 (FR) ..... 99 09416

(51) Int. Cl.

| | |
|---|---|
| ***B05D 3/00*** | (2006.01) |
| ***B23B 23/08*** | (2006.01) |
| *C08F 220/06* | (2006.01) |
| *C08L 23/00* | (2006.01) |

(52) U.S. Cl. ..... 427/391; 524/817; 524/819; 524/824; 524/832; 428/511

(58) Field of Classification Search ..... 524/817, 524/819, 824, 832; 427/391; 428/511
See application file for complete search history.

(56) References Cited

U.S. PATENT DOCUMENTS

| | | | | |
|---|---|---|---|---|
| 3,847,857 | A * | 11/1974 | Haag et al. | 524/530 |
| 4,423,118 | A * | 12/1983 | Corbett et al. | 428/514 |
| 4,474,919 | A | 10/1984 | Polatajko-Lobos et al. | |
| 4,775,420 | A | 10/1988 | Gonnet et al. | |
| 4,780,500 | A | 10/1988 | Sinka et al. | |
| 5,705,553 | A * | 1/1998 | Kuropka | 524/459 |
| 5,843,566 | A * | 12/1998 | Miyauchi et al. | 428/220 |
| 6,387,500 | B1 * | 5/2002 | Behl | 428/404 |

FOREIGN PATENT DOCUMENTS

| | | |
|---|---|---|
| EP | 0 737 728 | 10/1996 |
| JP | 56 101996 | 8/1981 |

* cited by examiner

*Primary Examiner*—Tae H. Yoon
(74) *Attorney, Agent, or Firm*—Oblon, Spivak, McClelland, Maier & Neustadt, P.C.

(57) ABSTRACT

The use, for the manufacture of paper coating colors, of a copolymer water-soluble in a neutral or alkaline medium as an agent for simultaneously adjusting the water retention of the coating colors and the Brookfield viscosity of the said coating colors; a water-retention agent comprising the copolymer; and coating colors and the coated paper and cardboard thus obtained.

9 Claims, 1 Drawing Sheet

WATER SOLUBLE RETENTION AGENT

The present application is a national stage application of PCT/FR00/01992, filed on Jul. 10, 2000, which claims priority to French patent application 99/09416, filed on Jul. 16, 1999.

DESCRIPTION OF THE INVENTION

The present invention relates to the technical sector of paper and cardboard manufacture, and in particular the sector concerning water-retention agents and rheology modifying agents used for the manufacture of coating colors.

BACKGROUND OF THE INVENTION

It is known that, in the techniques of coating sheets of paper, cardboard or the like, there is deposited on the support surface or surfaces a coating composition which can contain one or more mineral fillers, one or more binders and various additives.

Amongst these additives are water-retention agents, not to be confused with agents for the retention of fines or filler on the wire during the manufacture of the paper.

A composition for coating paper generally consists of a filler, which can be one or more pigments, one or more polymer binders and various additives such as in particular a lubricant such as a calcium stearate, a wax or a fatty acid ester, and possibly antifoaming agents and the like, well-known to persons skilled in the art.

After deposition on the support, the coating color has a natural tendency to transfer into the support all or part of the water and the water-soluble parts which it contains. It is necessary to control excessively rapid migration, which would impair the physical and optical characteristics of the coating.

It is therefore sought to retain the water in the coating composition or coating color. Thus this water retention must be controlled, in order to prevent changes in the rheology of the unused coating color recycled in the coating process.

Use is habitually made, as a water-retention agent, of natural or synthetic agents such as carboxymethylcellulose (CMC), starch, polyvinyl alcohols (PVAs) or certain latexes or emulsions of polymers with a high carboxyl content or polycarboxylates, for example of the polyacrylate type. Such substances are described, for example, in the patent EP 0 509 878.

A particular class of retention agent is known as alkali swellable polymers, and is described in the aforementioned patent, and as prior art in U.S. Pat. No. 4,780,500, which describes water-retention agents consisting mainly of acrylic acid monomer and secondarily itaconic acid monomer, with a molecular weight of 100,000 to 800,000.

It is also known that known products of the PVA or CMC type have limited use because of the high viscosities which they develop in the coating colors in parallel to their efficacy with respect to water-retention.

Thus such additives pose the following problems:

- the need for compatibility with the other ingredients in the coating color, such as the pigments such as carbonates, kaolin and the like, or binders such as latexes of the SBR type (styrene-butadiene-rubber latex), and other ingredients well know to persons skilled in the art;

- increase in the viscosity up to values which are not optimal for the preparation and use of the coating color;
- risk of affecting machinability;
- risk of affecting the properties of the coating color or properties of the manufactured coated paper, such as a good gloss;
- coating splashes;
- the formation of dribbles during the deposition which may go as far as the presence of scratches on the coated paper, also referred to as the phenomenon of "bleading".

The problem posed by the current inadequacies of the technology in this regard is therefore managing to reconcile often contradictory requirements, such as in particular the need for excellent water-retention in the coating color, which, according to current knowledge, can be obtained only by the addition of additives increasing the viscosity of the coating color but which may pose problems of machinability and also problems because, by hypothesis, the viscosity of the coating color becomes too high compared with the optimum value which would be desirable.

The invention relates in particular to agents aimed at obtaining the above properties.

It has been sought in the prior art to resolve this problem in various ways, particularly in the following documents, which can be classified in several categories.

It has notably been sought in the prior art to produce agents consisting of non water-soluble copolymers, such as for example in the German patent document DD 231 819, which concerns to binders adapted to coating colors and which procure effects which are unfavourable to the rheological properties.

U.S. Pat. No. 4,474,919 also describes non water-soluble agents of the latex type containing styrene and for example acrylic acid.

Likewise, the patent FR 2 675 165 relates to a composition for the coating of paper with an alkaline pH comprising a mixture of two insoluble latexes with special granulometries, these granulometries forming the essential teachings of this patent, and a mineral pigment, also clearly specified, aimed at improving water retention and machinability, with a "suitable" viscosity. It should be noted that the granulometry is also the main teaching of the patent FR 2 740 456.

Likewise, the document JP 58-054096 is known, which describes agents which, according to the proportions of their components, are latexes.

The patent JP-56101996 can also be cited, which, relating to a mixture of a styrene and maleic acid semi-ester copolymer and a terpolymer of styrene, acrylic acid and acrylic ester, says nothing about the simultaneous control of the viscosity and water retention of the coating color.

The same analysis applies to the patent JP-56101995.

Likewise, the patent DD 151 463 describes a viscosity regulating latex which is of the conventional binder type and relates only to the improvement in the viscosity and not the water retention.

U.S. Pat. No. 5,650,458 also describes compositions based on mixtures of styrene polymer and possibly acrylic acid, butyl-benzyl phthalate, butadiene-styrene latex, and a styrene and acrylic acid copolymer. This document relates only to the water retention and the quality of the final paper.

Equally, the patent JP-55018423 describes an acrylic acid copolymer and other monomers such as styrene in order to produce a simple dispersant which improves only the flow characteristics of the coating color.

Thus styrene and (meth)acrylic monomers are naturally monomers known in general terms in the field of coating colors for paper, and also in many other fields such as dispersants, agents for paint, etc.

As can be seen from a reading of the above analysis, the prior art does not particularly direct persons skilled in the art towards a choice of comonomers for resolving the problems the solution of which the invention relates to.

On the contrary, the prior art shows that many comonomers are used for different or very specific purposes, such as the viscosity properties, or water retention, or as dispersants, or as conventional binders, or co-binders etc, and for preparing both water-soluble and insoluble copolymers.

BRIEF SUMMARY OF THE INVENTION

The merit of the invention is to have approached the problem from a different angle by seeking a single agent which makes it possible to resolve the entire aforementioned problem and its technical components, also described above.

It has now been discovered that the use of certain copolymers makes it possible to simultaneously adjust on the one hand the water retention of paper coating colors for the manufacture of paper and cardboard, and on the other hand the viscosity of the said coating colors.

Figure 1:
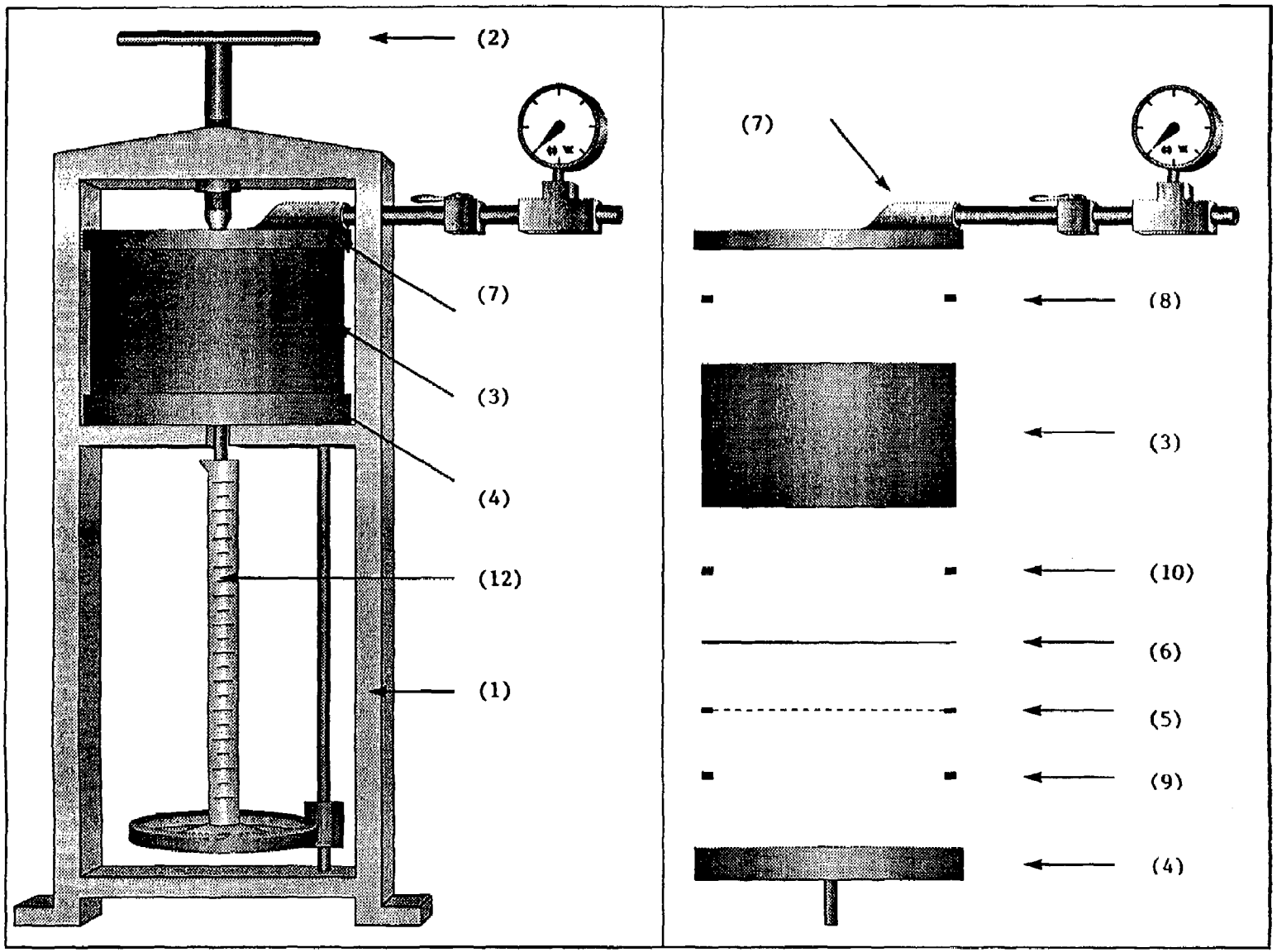
FIG. 1 depicts an "API Fluid Loss Measurement" filter press.

Thus one of the aims of the invention consists of the use, for manufacturing paper coating colors, of a copolymer as an agent for simultaneously adjusting the water retention of the coating color and its Brookfield viscosity, that is to say making it possible to obtain simultaneously a high water retention in the coating color and a low Brookfield viscosity of the said coating color or a high water retention in the coating color and a high Brookfield viscosity of the said coating color when the latter is required by the final user.

This use is characterised in that the said copolymer is water soluble in a neutral or alkaline medium and in that it consists of copolymers composed of:

A) 25% to 45% by weight monomer units whose homopolymer has a Tg>90° C.,

B) 30% to 65% by weight anionic monomer units,

C) 0% to 30% by weight non-ionic monomer units other than the monomers A),

D) 0% to 5% by weight cross-linking monomer units.

A copolymer which is water-soluble in a neutral or alkaline medium means, according to the Applicant, copolymers which give a homogeneous solution which is clear to cloudy in a neutral or alkaline medium.

According to a preferred embodiment, the invention proposes the use of an agent on the one hand adjusting the water retention of coating colors for the manufacture of paper and cardboard, and on the other hand making it possible to adjust, without supplementary additives, the viscosity of the said coating color, a use characterised in that the said agent is water-soluble in a neutral or alkaline medium and in that it consists of copolymers composed of:

A) 25% to 45% by weight monomer units chosen from amongst styrene, α-methylstyrene and their derivatives or methyl methacrylate, B) 30% to 65% by weight anionic monomer units chosen from amongst acrylic acid or methacrylic acid or their mixtures and possibly chosen from amongst:

acrylamido methyl propane sulphonic acid or AMPS, ethylene glycol or propylene glycol (meth)acrylate phosphates, sulphates, phosphonates or sulphonates, sodium methallylsulphonate (MTAS) or allylsulphonate, itaconic acid, sodium styrene sulphonate, tetrahydrophthalic anhydride.

C) 0% to 30% by weight non-ionic monomer units other than the monomers A) chosen non-limitatively from amongst acrylic or methacrylic acid esters or ethers, oxyalkylated monomers with ethylenic non-saturation terminated by a chain, linear or branched, such as the linear or branched alkyl, aryl, alkylaryl or arylalkyl groups having 1 to 50 carbon atoms and in particular the di- tri- and tetrastyrylphenol groups, the nonylphenols or others, or chosen from amongst vinyl esters, allyl esters or diisobutylene, vinylpyrrolidone, vinylcaprolactam, acrylonitrile, unsaturated urethanes, acrylamides and methyacrylamides, substituted or not, D) 0% to 5% by weight crosslinking monomer units chosen from amongst the monomers having at least two ethylenic non-saturations.

According to a particular embodiment, the invention proposes the use of an agent on the one hand adjusting the water retention of coating colors for manufacturing paper and cardboard, and on the other hand making it possible to adjust, without supplementary additives, the viscosity of the said coating color, a use characterised in that the said agent is water-soluble in a neutral or alkaline medium and in that it consists of copolymers composed of:

A) 25% to 45% by weight monomer units chosen from amongst styrene, α-methylstyrene and their derivatives or methyl methacrylate, B) 30% to 65% by weight anionic monomer units chosen from amongst acrylic acid or methacrylic acid or their mixtures and possibly chosen from amongst:

acrylamido methyl propane sulphonic acid or AMPS, ethylene glycol or propylene glycol (meth)acrylate phosphates, sulphates, phosphonates or sulphonates, sodium methallylsulphonate (MTAS) or allylsulphonate, itaconic acid, sodium styrene sulphonate, tetrahydrophthalic anhydride.

C) 0% to 30% by weight non-ionic monomer units other than the monomers A) chosen more particularly from amongst methyl, ethyl, butyl, 2-ethyl-hexyl, ethylene or propylene glycol acrylates or methacrylates, oxyethylated acrylates or methacrylates terminated by a chain, linear or branched, such as the linear or branched alkyl, aryl, alkylaryl or arylalkyl groups with 1 to 50 carbon atoms and in particular the di-, tri- and tetrastyrylphenol groups, nonylphenols, vinyl acetate, allyl ethers or diisobutylene, vinylpyrrolidone, vinylcaprolactam, acrylonitrile, acrylurethanes, methacrylurethanes, α-α'dimethyl-m-isopropenylbenzyl urethane, allylurethane, acrylamides and methacrylamides, substituted or not.

D) 0% to 5% by weight monomer units having at least two ethylenic non-saturations chosen non-limitatively from the group consisting of ethylene glycol dimethacrylate, trimethylolpropanetriacrylate, allyl acrylate, allyl maleates, methylene-bis-acrylamide, methylene-bis-methacrylamide, tetrallyloxyethane, the triallylcyanurates, the trivinylcyclohexane, the allyl ethers obtained from polyols such as pentaerythritol, sorbitol, sucrose or others.

The invention therefore also proposes a novel agent, on the one hand adjusting the water retention of coating colors for the manufacture of paper and cardboard, and on the other hand making it possible to adjust, without supplementary additives, the viscosity of the said coating color. This novel agent is characterised in that it is the copolymer defined above.

A high water retention in coating colors means, in the context of the invention, a water retention greater than that of the prior art, for an equal Brookfield viscosity.

A low Brookfield viscosity means, in the context of the invention, a viscosity less than that of the prior art, for an equal water retention.

The invention also relates to the coating colors containing the said agent.

These coating colors according to the invention are characterised in that they contain, in addition to the usual additives, 0.1% to 2.0% by weight dry and preferentially 0.5% to 1.0% by dry weight, with respect to the dry weight of the fillers, of the novel agent according to the invention.

These coating colors according to the invention are prepared in a conventional manner by persons skilled in the art by mixing in water aqueous suspensions of mineral fillers such as for example natural calcium carbonates, notably chalk, calcite, marble or synthetic calcium carbonates, dolomites, kaolins, talc, titanium dioxide, satin white, mica, calcinated clay, aluminium hydroxide, calcium sulphate or mixtures thereof, the water retention agent, possibly one or more binders of natural or synthetic origin such as for example casein, starch, carboxymethylcellulose, polyvinyl alcohols or latex of the styrene-acrylate or styrene-butadiene type or acrylic or vinyl latexes or others.

The coating colors according to the invention can also contain, in a known fashion, usual additives such as rheology modifiers, organic fillers, anti-foaming agents, optical brighteners, biocides, lubricants, alkaline hydroxides, insolubility agents such as for example ureas and/or melamine formaldehyde, epichlorhydrin, and others.

According to the invention, the paper coating colors containing one or more fillers, the water retainer or retainers, possibly one or more polymer binders, pigments, optical brighteners and various other paper additives are characterised in that the water retention and Brookfield viscosities of the paper coating colors are simultaneously adjusted by the use of the water retention agent according to the invention.

The water retention of the coating colors is determined by the method described below.

The paper coating color to be tested is subjected to a pressure of 100 psi (7 bars) in a standard cylinder, equipped with a surface of the filter paper type capable of allowing water to pass.

After 20 minutes, the volume of water collected is measured in ml.

The lower the volume of water collected at the end of 20 minutes, the better is the retention.

To do this, use is made of an "API Fluid Loss Measurement" filter press (FIG. 1/1) from Baroïd, which is composed essentially of a clamp (1) provided with a clamping screw (2) for locking the three parts of the filter body (3).

This body (3) is composed of:

- a base (4) with a hole provided with a nozzle through which the filtrate flows. This base (4) supports a metallic sieve (5) with a mesh of 60 to 80, on which is placed the 90 mm diameter filter paper (6) (Whatman™ No. 50), the equivalent of which is the DURIEUX BLEU™ No. 3 type,
- a cylinder with an inside diameter of 76.2 mm and a height of 128 mm,
- a cover (7) provided with a compressed gas inlet, whose seal with the cylinder is provided by means of a flat joint (8), of the same type as those (9) placed on the base (4).

To use the filter press, the following are fitted in the following order:

the joint (9) on the base (4)

the sieve (5) on the joints (9)

the filter paper (6) on the sieve (5)

the second joint (10) on the filter paper (6)

and the cylinder is fitted on the base (4) before locking the bayonet system.

Then it is filled with the coating color to be tested (approximately 480 g up to 3 cm from the top of the cylinder) before placing the cover (7) on the cylinder, interposing a joint (8).

Then the assembly is placed in the clamp (1) and is locked by means of the clamping screw (2), and then a graduated tube (12) is arranged underneath the nozzle.

A pressure of 7 bars is applied, simultaneously triggering a chronometer.

After 20 minutes the volume of fluid collected in the test tube (12) is noted. The accuracy of the result obtained is ±0.2 ml.

The invention finally relates to the papers and cardboards coated with the coating colors according to the invention.

Other characteristics and advantages of the invention will emerge more clearly from a reading of the following description, with reference to the examples below, which should not be regarded as having any character limitative of the invention.

EXAMPLE 1

This example relates to the evaluation of the efficacy of the agents according to the invention by determining the different Brookfield viscosity and water retention values of the different 100% calcium carbonate coating colors which are composed of:

- 100 parts, expressed as dry matter, of an aqueous suspension of calcium carbonate sold by Omya under the name "HYDROCARB™ 90/8 ME",
- 12 parts, expressed as dry matter, of a styrene-butadiene latex sold by Dow under the name "DL 950",
- 0.5 parts, expressed as dry matter, of the water retention agent to be tested, with the exception of the coating color of Test No. 2, which contains 0.1 parts thereof.

Test No. 1:

This test illustrates the prior art and uses a carboxymethylcellulose (CMC) A with a viscosity between 50 and 200 mPa·s measured in a 4% aqueous solution at 25° C.

The dry matter content of the coating color is around 65.8% and the pH is around 8.6 by adjustment with an aqueous solution of sodium hydroxide.

Test No. 2:

This test illustrates the prior art and uses a carboxymethylcellulose (CMC) A with a viscosity between 50 and 200 mPa·s measured in a 4% aqueous solution at 25° C.

The dry matter content of the coating color is around 66.2% and the pH is around 8.6 by adjustment with an aqueous solution of sodium hydroxide.

Test No. 3:

This test illustrates the prior art and uses a carboxymethylcellulose (CMC) B with a viscosity between 20 and 50 mPa·s measured in a 4% aqueous solution at 25° C.

The dry matter content of the coating color is around 66.2% and the pH is around 8.6 by adjustment with an aqueous solution of sodium hydroxide.

Test No. 4:

This test illustrates the prior art and uses a carboxymethylcellulose (CMC) C with a viscosity of between 200 and 500 mPa·s measured in a 4% aqueous solution at 25° C.

The dry matter content of the coating color is around 66.2% and the pH is around 8.6 by adjustment with an aqueous solution of sodium hydroxide.

Test No. 5:

This test illustrates the prior art and uses a water retention agent of the prior art composed, as a percentage by mass of monomer, of 37% methacrylic acid and 63% ethyl acrylate.

The dry matter content of the coating color is around 66.1% and the pH is around 8.6 by adjustment with an aqueous solution of sodium hydroxide.

Test No. 6:

This test illustrates the invention and uses a agent according to the invention composed of:

40.6% by weight styrene, 44.1% by weight methacrylic acid, 15.3% by weight butyl acrylate.

The dry matter content of the coating color is around 65.8% and the pH is around 8.6 by adjustment with an aqueous solution of sodium hydroxide.

Test No. 7:

This test illustrates the invention and uses an agent according to the invention composed of:

40.6% by weight methyl methacrylate, 44.1% by weight methacrylic acid, 15.3% by weight butyl acrylate.

The dry matter content of the coating color is around 66.1% and the pH is around 8.6 by adjustment with an aqueous solution of sodium hydroxide.

Test No. 8:

This test illustrates the invention and uses an agent according to the invention composed of:

30.6% by weight styrene, 44.1% by weight methacrylic acid, 15.3% by weight butyl acrylate, 10.0% by weight tristyrylphenol methacrylate oxyethylated by 2 moles of ethylene oxide.

The dry matter content of the coating color is around 66.0% and the pH is around 8.6 by adjustment with an aqueous solution of sodium hydroxide.

Test No. 9:

This test illustrates the invention and uses an agent according to the invention composed of:

31.0% by weight styrene, 53.7% by weight methacrylic acid, 15.3% by weight butyl acrylate.

The dry matter content of the coating color is around 66.2% and the pH is around 8.6 by adjustment with an aqueous solution of sodium hydroxide.

Test No. 10:

This test illustrates the invention and uses an agent according to the invention composed of:

39.7% by weight styrene, 43.1% by weight methacrylic acid, 15.0% by weight butyl acrylate.

2.2% by weight ethylene glycol dimethacrylate.

The dry matter content of the coating color is around 66.1% and the pH is around 8.6 by adjustment with an aqueous solution of sodium hydroxide.

Test No. 11:

This test illustrates the invention and uses an agent according to the invention composed of:

40.6% by weight styrene, 30.8% by weight methacrylic acid, 13.3% by weight acrylic acid, 15.3% by weight butyl acrylate.

The dry matter content of the coating color is around 65.9% and the pH is around 8.5 by adjustment with an aqueous solution of sodium hydroxide.

Test No. 12:

This test illustrates the invention and uses an agent according to the invention composed of:

40.6% by weight styrene, 35.2% by weight methacrylic acid, 15.3% by weight butyl acrylate, 8.9% by weight ethylene glycol methacrylate.

The dry matter content of the coating color is around 66.1% and the pH is around 8.6 by adjustment with an aqueous solution of sodium hydroxide.

Test No. 13:

This test illustrates the invention and uses an agent according to the invention composed of:

39.7% by weight styrene, 43.1% by weight methacrylic acid, 15.0% by weight butyl acrylate, 2.2% by weight trivinyl cyclohexane.

The dry matter content of the coating color is around 66.1% and the pH is around 8.6 by adjustment with an aqueous solution of sodium hydroxide.

Test No. 14:

This test illustrates the invention and uses an agent according to the invention composed of:

40.1% by weight styrene, 43.5% by weight methacrylic acid, 13.1% by weight butyl acrylate, 1.3% by weight ethylene glycol dimethacrylate.

The dry matter content of the coating color is around 65.8% and the pH is around 8.5 by adjustment with an aqueous solution of sodium hydroxide.

The results of the water retention measurement obtained according to the method described above in the description are set out in Table 1 below.

The results of the measurements of Brookfield viscosity determined at 10 and 100 revolutions per minute at 25° C. by means of a Brookfield viscometer type DV-1 equipped with the appropriate spindle also appear in Table 1.

TABLE 1

| | | PRIOR ART | | | | | INVENTION | | | | | | | | |
|---|---|---|---|---|---|---|---|---|---|---|---|---|---|---|---|
| Test No | | 1 | 2 | 3 | 4 | 5 | 6 | 7 | 8 | 9 | 10 | 11 | 12 | 13 | 14 |
| Filler: $CaCO_3$ (dry) | | 100 | 100 | 100 | 100 | 100 | 100 | 100 | 100 | 100 | 100 | 100 | 100 | 100 | 100 |
| Binder: Styrene butadiene latex (dry) | | 12 | 12 | 12 | 12 | 12 | 12 | 12 | 12 | 12 | 12 | 12 | 12 | 12 | 12 |
| Additive (dry): | | | | | | | | | | | | | | | |
| CMC A | | 0.5 | | | | | | | | | | | | | |
| CMC A | | | 0.1 | | | | | | | | | | | | |
| CMC B | | | | 0.5 | | | | | | | | | | | |
| CMC C | | | | | 0.5 | | | | | | | | | | |
| Copolymer Test No 5 | | | | | | 0.5 | | | | | | | | | |
| Copolymer Test No 6 | | | | | | | 0.5 | | | | | | | | |
| Copolymer Test No 7 | | | | | | | | 0.5 | | | | | | | |
| Copolymer Test No 8 | | | | | | | | | 0.5 | | | | | | |
| Copolymer Test No 9 | | | | | | | | | | 0.5 | | | | | |
| Copolymer Test No 10 | | | | | | | | | | | 0.5 | | | | |
| Copolymer Test No 11 | | | | | | | | | | | | 0.5 | | | |
| Copolymer Test No 12 | | | | | | | | | | | | | 0.5 | | |
| Copolymer Test No 13 | | | | | | | | | | | | | | 0.5 | |
| Copolymer Test No 14 | | | | | | | | | | | | | | | 0.5 |
| pH | | 8.6 | 8.6 | 8.6 | 8.6 | 8.6 | 8.6 | 8.6 | 8.6 | 8.6 | 8.6 | 8.5 | 8.6 | 8.6 | 8.5 |
| Dry extract | % | 65.8 | 66.2 | 66.2 | 66.2 | 66.1 | 65.8 | 66.1 | 66.0 | 66.2 | 66.1 | 65.9 | 66.1 | 66.1 | 65.8 |
| Brookfield viscosities mPas | 10 rev/min | 7280 | 1380 | 6000 | 10520 | 16300 | 840 | 5920 | 2260 | 7300 | 1350 | 1720 | 770 | 2320 | 1420 |
| | 100 rev/min | 1160 | 360 | 960 | 1600 | 2750 | 320 | 1120 | 660 | 1460 | 480 | 500 | 275 | 610 | 340 |
| Water retention (ml) | Vol in 20 min | 5.0 | 5.9 | 5.7 | 3.6 | 1.5 | 5.0 | 3.1 | 2.6 | 1.7 | 4.3 | 4.6 | 4.5 | 3.9 | 4.9 |

A reading of Table 1 shows on the one hand that, with respect to a viscosity and water retention pair, referred to here as standard, and represented by Test No. 1, the prior art does not make it possible to reduce (Tests No. 2 and No. 3) or raise (Tests No. 4 and No. 5) the viscosity and water retention except concomitantly.

Moreover this Table 1 shows that, with respect to a viscosity and water retention pair, here referred to as standard, and represented by Test No. 1 of the prior art, the object of the invention represented by Tests 6, 7, 8, 10, 11 and 12 makes it possible to obtain water retentions greater than or equal to the standard with corresponding viscosities less than that of the standard.

Test No. 9 shows that a water retention value three times greater than that of the standard is obtained for a viscosity value slightly greater than that of the standard of the prior art.

EXAMPLE 2

This example relates to the evaluation of the efficacy of the agents according to the invention by determining the different Brookfield viscosity and water retention values of the different coating colors (80% calcium carbonate-20% kaolin), which are composed of:

80 parts, expressed as dry matter, of an aqueous suspension of calcium carbonate sold by Omya under the name "HYDROCARB™ 90/78 ME", 20 parts, expressed as dry matter, of a kaolin sold by Huber under the name "HYDRAGLOSS™ 90", 12 parts, expressed as dry matter, of a styrene-butadiene latex sold by Dow under the name "DL 950", 0.5 parts, expressed as dry matter, of the water retention agent to be tested, with the exception of the coating color of Test No. 16, which contains 0.1 parts thereof.

Test No. 15:

This test illustrates the prior art and uses a carboxymethylcellulose (CMC) A with a viscosity between 50 and 200 mPa·s measured in a 4% aqueous solution at 25° C.

The dry matter content of the coating color is around 65.8% and the pH is around 8.6 by adjustment with an aqueous solution of sodium hydroxide.

Test No. 16:

This test illustrates the prior art and uses a carboxymethylcellulose (CMC) A with a viscosity of between 50 and 200 mPa·s measured in a 4% aqueous solution at 25° C.

The dry matter content of the coating color is around 66.2% and the pH is around 8.6 by adjustment with an aqueous solution of sodium hydroxide.

Test No. 17:

This test illustrates the prior art and uses a carboxymethylcellulose (CMC) B with a viscosity of between 20 and 50 mPa·s measured in a 4% aqueous solution at 25° C.

The dry matter content of the coating color is around 66.0% and the pH is around 8.6 by adjustment with an aqueous solution of sodium hydroxide.

Test No. 18:

This test illustrates the prior art and uses a carboxymethylcellulose (CMC) C with a viscosity of between 200 and 500 mpa·s measured in a 4% aqueous solution at 25° C.

The dry matter content of the coating color is around 66.1% and the pH is around 8.6 by adjustment with an aqueous solution of sodium hydroxide.

Test No. 19:

This test illustrates the prior art and uses a water retention agent of the prior art composed, as a percentage by mass of monomer, 37% methacrylic acid and 63% ethyl acrylate.

The dry matter content of the coating color is around 66.0% and the pH is around 8.6 by adjustment with an aqueous solution of sodium hydroxide.

Test No. 20:

This test illustrates the invention and uses an agent according to the invention composed of:

40.6% by weight styrene, 44.1% by weight methacrylic acid, 15.3% by weight butyl acrylate.

The dry matter content of the coating color is around 66.2% and the pH is around 8.6 by adjustment with an aqueous solution of sodium hydroxide.

Test No. 21:

This test illustrates the invention and uses an agent according to the invention composed of:

40.6% by weight methyl methacrylate, 44.1% by weight methacrylic acid, 15.3% by weight butyl acrylate.

The dry matter content of the coating color is around 65.9% and the pH is around 8.6 by adjustment with an aqueous solution of sodium hydroxide.

Test No. 22:

This test illustrates the invention and uses an agent according to the invention composed of:

30.6% by weight styrene, 44.1% by weight methacrylic acid, 15.3% by weight butyl acrylate, 10.0% by weight tristyrylphenol methacrylate oxyethylated by 2 moles of ethylene oxide.

The dry matter content of the coating color is around 66.0% and the pH is around 8.6 by adjustment with an aqueous solution of sodium hydroxide.

Test No. 23:

This test illustrates the invention and uses an agent according to the invention composed of:

31.0% by weight styrene, 53.7% by weight methacrylic acid, 15.3% by weight butyl acrylate.

The dry matter content of the coating color is around 65.8% and the pH is around 8.6 by adjustment with an aqueous solution of sodium hydroxide.

Test No. 24:

This test illustrates the invention and uses an agent according to the invention composed of:

39.7% by weight styrene, 43.1% by weight methacrylic acid, 15.0% by weight butyl acrylate, 2.2% by weight ethylene glycol dimethacrylate.

The dry matter content of the coating color is around 66.0% and the pH is around 8.6 by adjustment with an aqueous solution of sodium hydroxide.

Test No. 25:

This test illustrates the invention and uses an agent according to the invention composed of:

40.6% by weight styrene, 30.8% by weight methacrylic acid, 13.3% by weight acrylic acid, 15.3% by weight butyl acrylate.

The dry matter content of the coating color is around 66.1% and the pH is around 8.5 by adjustment with an aqueous solution of sodium hydroxide.

Test No. 26:

This test illustrates the invention and uses an agent according to the invention composed of:

40.6% by weight styrene, 35.2% by weight methacrylic acid, 15.3% by weight butyl acrylate, 8.9% by weight ethylene glycol methacrylate.

The dry matter content of the coating color is around 65.9% and the pH is around 8.6 by adjustment with an aqueous solution of sodium hydroxide.

Test No. 27:

This test illustrates the invention and uses an agent according to the invention composed of:

39.7% by weight styrene, 43.1% by weight methacrylic acid, 15.0% by weight butyl acrylate, 2.2% by weight trivinyl cyclohexane.

The dry matter content of the coating color is around 66.0% and the pH is around 8.6 by adjustment with an aqueous solution of sodium hydroxide.

Test No. 28:

This test illustrates the invention and uses an agent according to the invention composed of:

40.1% by weight styrene, 43.5% by weight methacrylic acid, 13.1% by weight butyl acrylate, 1.3% by weight ethylene glycol dimethacrylate.

The dry matter content of the coating color is around 65.6% and the pH is around 8.6 by adjustment with an aqueous solution of sodium hydroxide.

Test No. 29:

This test illustrates the invention and uses an agent according to the invention composed of:

30.0% by weight styrene, 60.0% by weight methacrylic acid, 10.0% by weight butyl acrylate.

The dry matter content of the coating color is around 65.8% and the pH is around 8.6 by adjustment with an aqueous solution of sodium hydroxide.

The results of the measurement of water retention obtained according to the method described above in the description are set out in Table 2 below.

The results of the measurements of Brookfield viscosity determined at 10 and 100 revolutions per minute at 25° C. by means of a Brookfield viscometer type DV-1 equipped with the appropriate spindle also appear in Table 2.

TABLE 2

| | | PRIOR ART | | | | | INVENTION | | |
|---|---|---|---|---|---|---|---|---|---|
| Test No | | 15 | 16 | 17 | 18 | 19 | 20 | 21 | 22 |
| Filler: $CaCO_3$ (dry) | | 80 | 80 | 80 | 80 | 80 | 80 | 80 | 80 |
| Filler: Kaolin (dry) | | 20 | 20 | 20 | 20 | 20 | 20 | 20 | 20 |
| Styrene butadiene latex (dry) | | 12 | 12 | 12 | 12 | 12 | 12 | 12 | 12 |
| Additive (dry): | | | | | | | | | |
| CMC A | | 0.5 | | | | | | | |
| CMC A | | | 0.1 | | | | | | |
| CMC B | | | | 0.5 | | | | | |
| CMC C | | | | | 0.5 | | | | |
| Copolymer Test No 19 | | | | | | 0.5 | | | |
| Copolymer Test No 20 | | | | | | | 0.5 | | |
| Copolymer Test No 21 | | | | | | | | 0.5 | |
| Copolymer Test No 22 | | | | | | | | | 0.5 |
| Copolymer Test No 23 | | | | | | | | | |
| Copolymer Test No 24 | | | | | | | | | |
| Copolymer Test No 25 | | | | | | | | | |
| Copolymer Test No 26 | | | | | | | | | |
| Copolymer Test No 27 | | | | | | | | | |
| Copolymer Test No 28 | | | | | | | | | |
| Copolymer Test No 29 | | | | | | | | | |
| pH | | 8.6 | 8.6 | 8.6 | 8.6 | 8.6 | 8.6 | 8.6 | 8.6 |
| Dry extract | % | 65.8 | 66.2 | 66 | 66.1 | 66 | 66.2 | 65.9 | 66.0 |
| Brookfield viscosities | 10 rev/min | 7470 | 2280 | 7040 | 11400 | 16900 | 1880 | 8040 | 4760 |
| mPas | 100 rev/min | 1280 | 480 | 1160 | 1880 | 2700 | 520 | 1610 | 1150 |
| Water retention (ml) | Vol in 20 min | 4.3 | 5.5 | 4.5 | 3.1 | 1.8 | 5.8 | 2.4 | 3.1 |

| | | INVENTION | | | | | | |
|---|---|---|---|---|---|---|---|---|
| Test No | | 23 | 24 | 25 | 26 | 27 | 28 | 29 |
| Filler: $CaCO_3$ (dry) | | 80 | 80 | 80 | 80 | 80 | 80 | 80 |
| Filler: Kaolin (dry) | | 20 | 20 | 20 | 20 | 20 | 20 | 20 |
| Styrene butadiene latex (dry) | | 12 | 12 | 12 | 12 | 12 | 12 | 12 |
| Additive (dry): | | | | | | | | |
| CMC A | | | | | | | | |
| CMC A | | | | | | | | |
| CMC B | | | | | | | | |
| CMC C | | | | | | | | |
| Copolymer Test No 19 | | | | | | | | |
| Copolymer Test No 20 | | | | | | | | |
| Copolymer Test No 21 | | | | | | | | |
| Copolymer Test No 22 | | | | | | | | |
| Copolymer Test No 23 | | 0.5 | | | | | | |
| Copolymer Test No 24 | | | 0.5 | | | | | |
| Copolymer Test No 25 | | | | 0.5 | | | | |
| Copolymer Test No 26 | | | | | 0.5 | | | |
| Copolymer Test No 27 | | | | | | 0.5 | | |
| Copolymer Test No 28 | | | | | | | 0.5 | |
| Copolymer Test No 29 | | | | | | | | 0.5 |
| pH | | 8.6 | 8.6 | 8.6 | 8.6 | 8.6 | 8.6 | 8.6 |
| Dry extract | % | 65.8 | 66.0 | 66.1 | 65.9 | 66.0 | 65.6 | 65.8 |
| Brookfield viscosities | 10 rev/min | 4530 | 4120 | 4680 | 1500 | 3000 | 2100 | 6800 |
| mPas | 100 rev/min | 860 | 910 | 1130 | 470 | 780 | 440 | 1560 |
| Water retention (ml) | Vol in 20 min | 2.2 | 3.0 | 4.2 | 5.5 | 4.8 | 5.1 | 2.6 |

A reading of Table 2 shows on the one hand that, with respect to a viscosity and water retention pair, referred to here as standard, and represented by Test No. 15, the prior art does not make it possible to reduce (Tests 16 and No. 17) or increase (Tests 18 and 19) the viscosity and water retention except concomitantly.

Moreover this Table 2 shows that, with respect to a viscosity and water retention pair, here referred to as standard, and represented by Test No. 15 of the prior art, the object of the invention represented by Tests 21, 22, 23, 24, 25 and 29 makes it possible to obtain water retentions greater than or equal to the standard with corresponding viscosities less than those of the prior art.

Tests 20 and 28 show that a water retention slightly less than that of the standard is obtained for a viscosity very appreciably less than that of the standard of the prior art.

EXAMPLE 3

This example relates to the use of various quantities of the agents according to the invention by determining the different Brookfield viscosity and water retention values of a 100% calcium carbonate coating color which is composed of:

100 parts, expressed as dry matter, of an aqueous suspension of calcium carbonate sold by Omya under the name "HYDROCARB™ 90 OG 75%", 12 parts, expressed as dry matter, of a styrene-butadiene latex sold by Dow under the name "DL 950", the quantity, expressed as dry matter, of the water retention agent to be tested.

Test No. 30:

This test illustrates the prior art and uses 0.1 part, expressed as dry matter, of a carboxymethylcellulose (CMC) A with a viscosity between 50 and 200 mPa·s measured in a 4% aqueous solution at 25° C.

The dry matter content of the coating color is around 66,1% and the pH is around 8.6 by adjustment with an aqueous solution of sodium hydroxide.

Test No. 31:

This test illustrates the prior art and uses 1.0 part, expressed as dry matter, of a carboxymethylcellulose (CMC) A with a viscosity between 50 and 200 mPa·s measured in a 4% aqueous solution at 25° C.

The dry matter content of the coating color is around 66.1% and the pH is around 8.6 by adjustment with an aqueous solution of sodium hydroxide.

Test No. 32:

This test illustrates the invention and uses 0.1 part, expressed as dry matter, of an agent according to the invention composed of:

40.3% by weight styrene, 31.0% by weight methacrylic acid, 13.3% by weight acrylic acid, 15.4% by weight butyl acrylate.

The dry matter content of the coating color is around 66.2% and the pH is around 8.5 by adjustment with an aqueous solution of sodium hydroxide.

Test No. 33:

This test illustrates the invention and uses 1.0 part, expressed as dry matter, as the same agent as the previous test.

The dry matter content of the coating color is around 66.0% and the pH is around 8.6 by adjustment with an aqueous solution of sodium hydroxide.

The results of the water retention measurement obtained according to the method described above in the description are set out in Table 3 below.

The results of the measurements of Brookfield viscosity determined at 10 and 100 revolutions per minute at 25° C. by means of a Brookfield viscometer type DV-1 equipped with the appropriate spindle also appear in Table 3.

TABLE 3

| | Prior art | | Invention | |
|---|---|---|---|---|
| Test N° | 30 | 31 | 32 | 33 |
| Filler: CaCO3 (dry) | 100 | 100 | 100 | 100 |
| Binder: styrene-butadiene latex (dry) | 12 | 12 | 12 | 12 |
| Additive (dry): | | | | |
| CMC | 0.1 | 1 | — | — |
| Copolymer test N° 32 | — | — | 0.1 | 1 |
| pH | 8.6 | 8.6 | 8.6 | 8.6 |
| Solid content | | | | |
| % | 66.1 | 66.1 | 66.2 | 66.0 |
| Brookfield viscosities mPas | | | | |
| 10 rev/min | 2020 | 14700 | 1090 | 1700 |
| 100 rev/min | 480 | 2250 | 290 | 530 |

TABLE 3-continued

| | Prior art | | Invention | |
|---|---|---|---|---|
| Test N° | 30 | 31 | 32 | 33 |
| Water-retention (ml) | | | | |
| Vol in 20 min | 11.0 | 5.8 | 11.0 | 6.2 |

The reading of table 3 shows the obtention of coating color according to the invention containing 0.1% to 2.0% by dry weight, with respect to the dry weight of the fillers, of the agent according to the invention.

The invention claimed is:

1. A method comprising coating paper or cardboard with a coating color, wherein the coating color comprises an agent for simultaneously adjusting the water retention of the coating color and its Brookfield viscosity, and wherein the agent comprises a copolymer that is water soluble in a neutral or alkaline medium, which copolymer comprises:

A) 25% to 45% by weight monomer units selected from the group consisting of styrene, α-methylstyrene, and mixtures thereof, B) 30% to 65% by weight anionic monomer units, C) an amount of 10% to 30% by weight non-ionic monomer units other than the monomers A), selected from the group consisting of oxyalkylated monomers with ethylenic non-saturation terminated by linear or branched alkyl, aryl, alkylaryl or arylalkyl groups having 1 to 50 carbon atoms, D) 0% to 5% by weight cross-linking monomer units.

2. The method of claim 1, wherein

B) comprises anionic monomer units selected from the group consisting of acrylic acid, methacrylic acid, mixtures thereof, acrylamido methyl propane sulphonic acid (AMPS), ethylene glycol or propylene glycol (meth)acrylate phosphates, sulphates, phosphonates or sulphonates, sodium methallylsulphonate (MTAS) or allylsulphonate, itaconic acid, sodium styrene sulphonate, and tetrahydrophthalic anhydride, C) further comprises non-ionic monomer units selected from the group consisting of acrylic and methacrylic acid esters and ethers, vinyl esters, allyl esters, diisobutylene, vinylpyrrolidone, vinylcaprolactam, acrylonitrile, unsaturated urethanes, acrylamides and methylacrylamides, D) comprises crosslinking monomer units selected from the group consisting of monomers having at least two ethylenic non-saturations.

3. The method of claim 2, wherein

C) the unsaturated urethanes are selected from the group consisting of acrylurethanes, methacrylurethanes, α-α'dimethyl-m-isopropenylbenzyl urethane, and allylurethane, D) the crosslinking monomer units are selected from the group consisting of ethylene glycol dimethacrylate, trimethylolpropanetriacrylate, allyl acrylate, allyl maleates, methylene-bis-acrylamide, methylene-bis-methacrylamide, tetrallyloxyethane, the triallylcyanurates, trivinylcyclohexane, and allyl ethers obtained from polyols.

4. Paper or cardboard coated with the coating color according to claim 1.

5. Paper or cardboard coated with the coating color according to claim 2.

6. Paper or cardboard coated with the coating color according to claim 3.

7. The method claim 1, wherein the non-ionic monomer units C) comprise di-, tri-, or tetrastyrylphenols or nonylphenols.

8. The method of claim 3, wherein D) the crosslinking monomer units are allyl esters obtained from polyols selected from the group consisting of pentaerythritol, sorbitol, and sucrose.

9. The method of claim 1, wherein D) is present in an amount greater than 0%.

* * * * *